US006784783B2

(12) United States Patent
Scoggin et al.

(10) Patent No.: US 6,784,783 B2
(45) Date of Patent: Aug. 31, 2004

(54) COMPACT FUSED DISCONNECT SWITCH

(75) Inventors: B. Heath Scoggin, Wildwood, MO (US); Ronald Emil Mollet, Ellisville, MO (US); Jaime Alberto Torrez, O'Fallon, MO (US)

(73) Assignee: Cooper Technologies Company, Houston, TX (US)

( * ) Notice: Subject to any disclaimer, the term of this patent is extended or adjusted under 35 U.S.C. 154(b) by 44 days.

(21) Appl. No.: 09/981,017

(22) Filed: Oct. 16, 2001

(65) Prior Publication Data

US 2002/0047770 A1 Apr. 25, 2002

Related U.S. Application Data

(60) Provisional application No. 60/242,786, filed on Oct. 24, 2000.

(51) Int. Cl.[7] ..... H01H 85/50; H01H 85/20

(52) U.S. Cl. ..... 337/194; 337/206; 337/255; 361/835; 361/837

(58) Field of Search ..... 337/167, 142, 337/186, 194, 206, 208, 241, 242, 245, 255, 265, 266, 1, 4, 5, 9; 361/104, 642, 646, 833, 835, 837, 626

(56) References Cited

U.S. PATENT DOCUMENTS

| | | | | | |
|---|---|---|---|---|---|
| 2,204,948 | A | * | 6/1940 | Pond | 337/226 |
| 3,432,789 | A | | 3/1969 | Poehlman, Jr. | |
| 4,194,806 | A | | 3/1980 | Macemon | |
| 4,794,211 | A | | 12/1988 | Hibbert et al. | |
| 4,906,212 | A | | 3/1990 | Mixon, Jr. | |
| 4,913,678 | A | | 4/1990 | Avellino et al. | |
| 5,260,679 | A | | 11/1993 | Viscogliosi | |
| 5,355,274 | A | | 10/1994 | Marach et al. | |
| 5,442,519 | A | * | 8/1995 | DeBalko et al. | 361/784 |
| 5,559,662 | A | | 9/1996 | Happ et al. | |
| 5,700,165 | A | | 12/1997 | Harris et al. | |
| 5,726,852 | A | * | 3/1998 | Trifiletti et al. | 361/115 |
| 5,739,737 | A | | 4/1998 | Hatton | |
| 5,775,940 | A | * | 7/1998 | Tanigawa | 439/507 |
| 5,788,543 | A | | 8/1998 | Rudoy et al. | |
| 5,841,337 | A | | 11/1998 | Douglass | |
| 5,963,411 | A | | 10/1999 | Mollet et al. | |
| 5,973,418 | A | | 10/1999 | Ciesielka et al. | |
| 6,002,580 | A | * | 12/1999 | LeVantine et al. | 361/634 |

(List continued on next page.)

FOREIGN PATENT DOCUMENTS

| | | | | |
|---|---|---|---|---|
| FR | 1.222.754 | | 1/1960 | |
| FR | 1.322.300 | | 2/1963 | |
| FR | 1322300 | | 12/1963 | |
| GB | 2365228 | | 2/2002 | |
| GB | 2366099 | | 2/2002 | |
| JP | 2000331572 A | * | 11/2000 | H01H/27/00 |
| WO | WO98/47200 | | 10/1998 | |
| WO | WO 98/56075 | | 12/1998 | |

OTHER PUBLICATIONS

The Patent Office, Search Report Under Sec. 17, Application No. GB 0125533.0, 2 pgs., Nov. 4, 2002.

U.S. patent application Publication No. US 2002/0064013 A1, May 30, 2002, Edwin Milanczak, "Fused Electrical Disconnect Device".

*Primary Examiner*—Anatoly Vortman
(74) *Attorney, Agent, or Firm*—Armstrong Teasdale LLP

(57) ABSTRACT

A fused disconnect switch includes at least one switch housing assembly having a housing defining a fuse receptacle and first and second terminal contact assemblies extending therefrom. At least one of the first and second contact assemblies is a bullet contact assembly, and a retractable fuse is received within the fuse receptacle. The fuse includes a primary fuse link and an open fuse indication device.

20 Claims, 11 Drawing Sheets

U.S. PATENT DOCUMENTS 6,062,914 A * 5/2000 Fasano ..... 439/716
D429,223 S * 8/2000 Douglass et al. ..... D13/178
6,122,160 A * 9/2000 Hannula ..... 361/600
6,157,287 A 12/2000 Douglass et al.
6,315,580 B1 * 11/2001 Hurtubise et al. ..... 439/82
6,317,311 B1 * 11/2001 Middlehurst et al. ..... 361/637
D452,484 S * 12/2001 Milanczak ..... D13/161
6,358,099 B1 * 3/2002 Kolody et al. ..... 439/716
6,359,770 B1 * 3/2002 Kolody et al. ..... 361/626
6,402,572 B1 * 6/2002 Sevier et al. ..... 439/748

* cited by examiner

COMPACT FUSED DISCONNECT SWITCH

CROSS REFERENCE TO RELATED APPLICATIONS

This application claims the benefit of U.S. Provisional Application No. 60/242,786 filed Oct. 24, 2000.

BACKGROUND OF THE INVENTION

This invention relates generally to fused assemblies, and, more particularly, to switchable fuse assemblies.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and open one or more circuits through the fuse to prevent electrical component damage.

In an era of ever-increasing communication services, overcurrent protection of telecommunication systems, such as distribution panels, has become an important issue. While a variety of products, both fuses and circuit breakers, are available to provide overcurrent protection, they exist in a variety of sizes and ratings that often results in an ad hoc assortment of fuses and circuit breakers to protect large, complicated, telecommunications systems. Additionally, capable fuse products exist only with limited mounting and wiring options. The assortment of shapes of overcurrent protection equipment and difficulties in wiring them tends to result in inefficient use of space in limited areas, such as distribution panels, as well as tends to complicate trouble-shooting and maintenance of the system, and also tends to complicate identification of operated fuses and/or tripped devices. As space becomes a premium in a competitive telecommunications industry, a more efficient overcurrent protection device is desired.

One means of efficiently employing a plurality of overcurrent protection devices is the use of a common input bus. Conventional overcurrent protection devices, however, typically include box clamp wiring features that are difficult to use with a line input bus.

BRIEF DESCRIPTION OF THE INVENTION

In an exemplary embodiment, a fused disconnect switch includes at least one switch housing assembly having a housing defining a fuse receptacle and first and second terminal contact assemblies extending therefrom. At least one of the first and second contact assemblies is a bullet contact assembly, and a retractable fuse is received within the fuse receptacle. The fuse includes a primary fuse link and an open fuse indication device.

As such, the bullet contact assembly facilitates connections to a line input bus, and the retractable fuse facilitates disconnection of the fused circuit with removal of the fuse for simplified maintenance of a protected system. Local and remote fuse state indication facilitates ready identification of operated fuses for replacement even when a large number of fuses are employed.

In other aspects of the invention threaded terminal stud contact assemblies are provided in combination with or in lieu of bullet contact assemblies to facilitate quick connection with a known fastener. The fuse may accommodate various primary fuse links of different ratings for use with the switch housing assembly, thereby facilitating use of a variety of fuse protection ratings with a single dimension or footprint that more efficiently utilizes an available space in, for example, a telecommunications panel system. Multiple fuse links may be employed in parallel with a single switch housing assembly for increased overcurrent protection capacity.

Therefore, at least for the reasons set forth above, a more efficient overcurrent protection device is provided with a plurality of mounting options to simplify installation in the field.

DETAILED DESCRIPTION OF THE INVENTION

Figure 1:
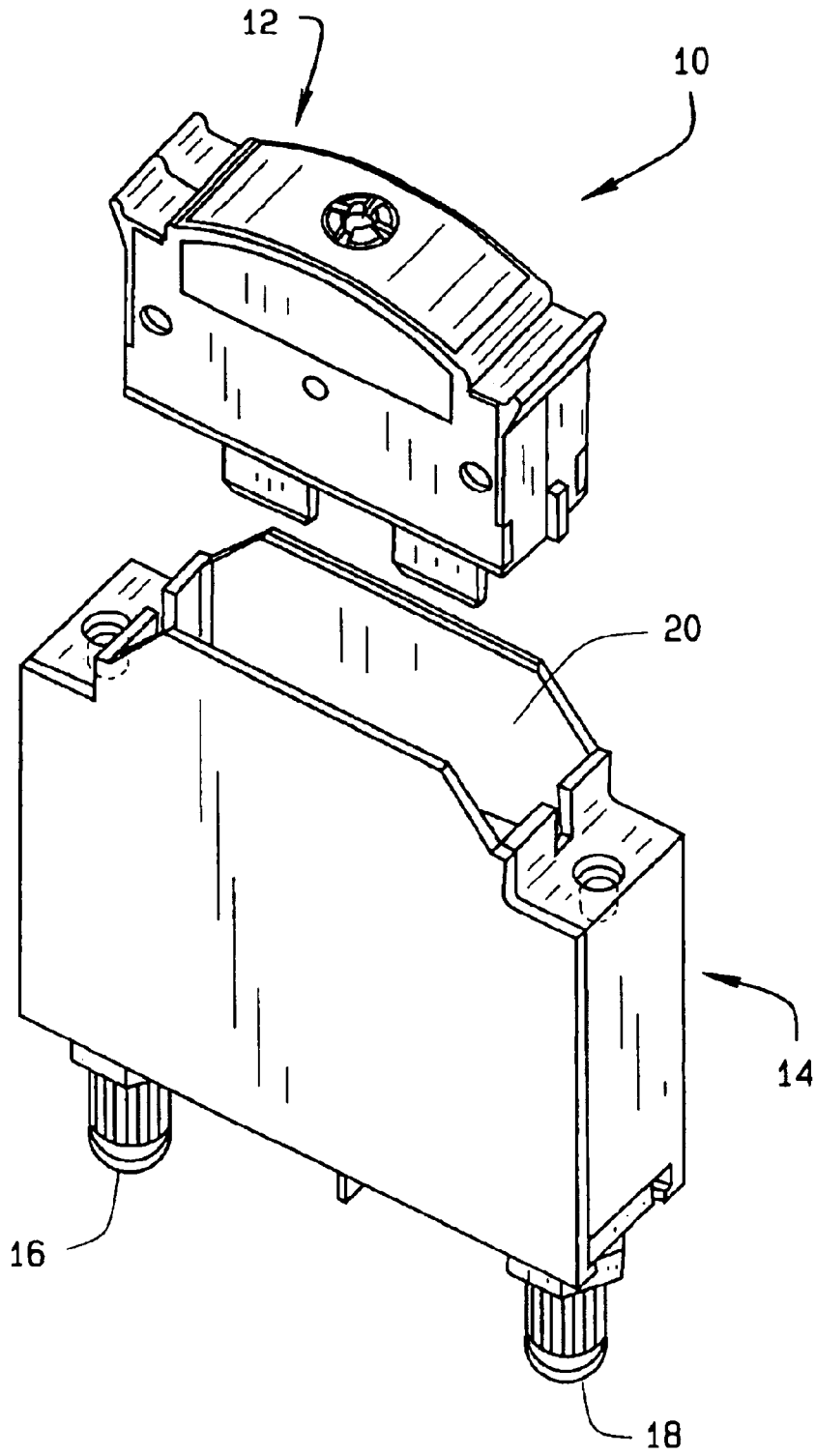
FIG. 1 is an exploded perspective view of a fused disconnect switch assembly.

FIG. 1 is an exploded perspective view of a fused disconnect switch assembly 10 including a fuse 12 for removable engagement with a switch housing assembly 14. Switch housing assembly 14 includes a first bullet contact assembly 16 for plug in connection to a line input bus (not shown) and a second bullet contact assembly 18 for plug in connection to load side equipment (not shown), such as a distribution panel. When fuse 12 is fully inserted into a switch housing assembly fuse receptacle 20, an electrical circuit is completed through fuse 12 via first and second bullet contact assemblies 16, 18. As such, fused disconnect switch assembly 10 is ideally suited, in an exemplary embodiment, for protecting telecommunications equipment from damaging fault currents as well as facilitating disconnection of the load by extraction of fuse 12 from switch housing assembly 14. It is understood, however, that the benefits of the present invention accrue generally to many fused systems, and the present invention is in no way intended to be restricted to any particular use or application.

Figure 2:
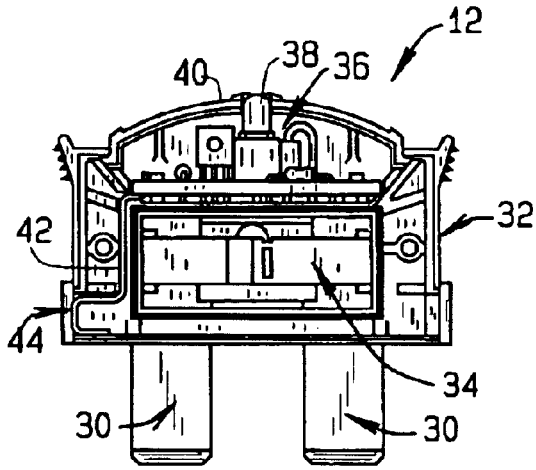
FIG. 2 is a cross-sectional view of the fuse shown in FIG. 1.

FIG. 2 is a cross-sectional view of fuse 12 (shown in FIG. 1) including first and second fuse terminals 30 extending from a fuse housing 32 and in electrical communication with a primary fuse link 34 mounted in fuse housing 32 and extending between first and second terminals 30. When an electrical circuit is completed through fuse terminals 30, current flows through primary fuse link 34, and as current flowing through primary fuse link 34 approaches a predetermined threshold, i.e., a fault current, primary fuse link 34 melts, vaporizes or otherwise opens and prevents electrical current from flowing therethrough. Thus, an open circuit is created between fuse terminals 30 and associated load-side electrical components and circuits are isolated by fuse 12 and thereby protected from damaging fault currents. An arc-quenching material (not shown), such as silica sand, may surround primary fuse link 34 within housing 32 to prevent and/or suppress arcing between fuse terminals 30 when primary fuse link 34 opens.

In one embodiment, primary fuse link 34 is fabricated so that fuse 12 has a rating of 25 to 125 amps and a safety interrupt of 100 kA at 80 Vdc. In addition, different fuse ratings are obtained with differently fabricated primary fused links 34 inside fuse housing 32 so that differently rated fuses have substantially the same size and shape, or footprint, so that a variety of different fuses may be employed with a single switch housing assembly for versatility in the field. It is contemplated, however, that the benefits of the present invention accrue to a wide variety of fused systems employing fuses of different ratings, shapes, and sizes. Therefore, the specific embodiments illustrated and described herein are for illustrative purposes only and are not intended to limit the invention in any aspect.

Fuse 12 also includes a local and remote open-fuse indication device 36 for indicating an operational state of fuse 12. In one embodiment, device 36 includes a high resistance electronic circuit, explained in detail below, that illuminates a light emitting diode ("LED") 38 when primary fuse link 34 is opened. LED 38 is visible through a top 40 of fuse housing 32 and, when illuminated, readily identifies an operated fuse for replacement. When employed in electrical systems with a large number of fuses, local fuse state indication via LED 38 is a significant advantage over conventional fuses.

In an alternative embodiment, open-fuse indication device 36 includes a secondary fuse link (not shown in FIG. 2) electrically connected between fuse terminals 30 in parallel with primary fuse link 34. The secondary fuse link has a much greater electrical resistance than primary fuse link 34 so that when fuse 12 is operational, i.e., when primary fuse link 34 has not opened, substantially all the current flowing through fuse 12 passes through primary fuse link 34. However, when primary fuse link 34 opens and the circuit is broken through primary fuse link 34, current flows through the secondary fuse link and triggers an electronic or mechanical indicator for local indication of the opened fuse via visual observation of fuse housing 32.

In further alternative embodiments, other known electrical, mechanical, or electromechanical devices are used to visibly indicate an operational state of fuse 12 for local fuse state indication.

Open fuse indication device 36 further includes an electrically conductive alarm terminal 42 protruding through an opening 44 in fuse housing 32. When fuse terminal alarm 42 is coupled to a resistive load, such as a relay coil (not shown) typically found in existing telecommunications equipment, a signal is sent to the relay coil when primary fuse link 34 has opened, thereby directing attention to a particular location where an opened fuse is located. Local fuse state indication identifies the open fuse or fuses in the specified location. Thus, opened fuses may be efficiently located even when large numbers of fuses in various locations are employed.

Figure 3:
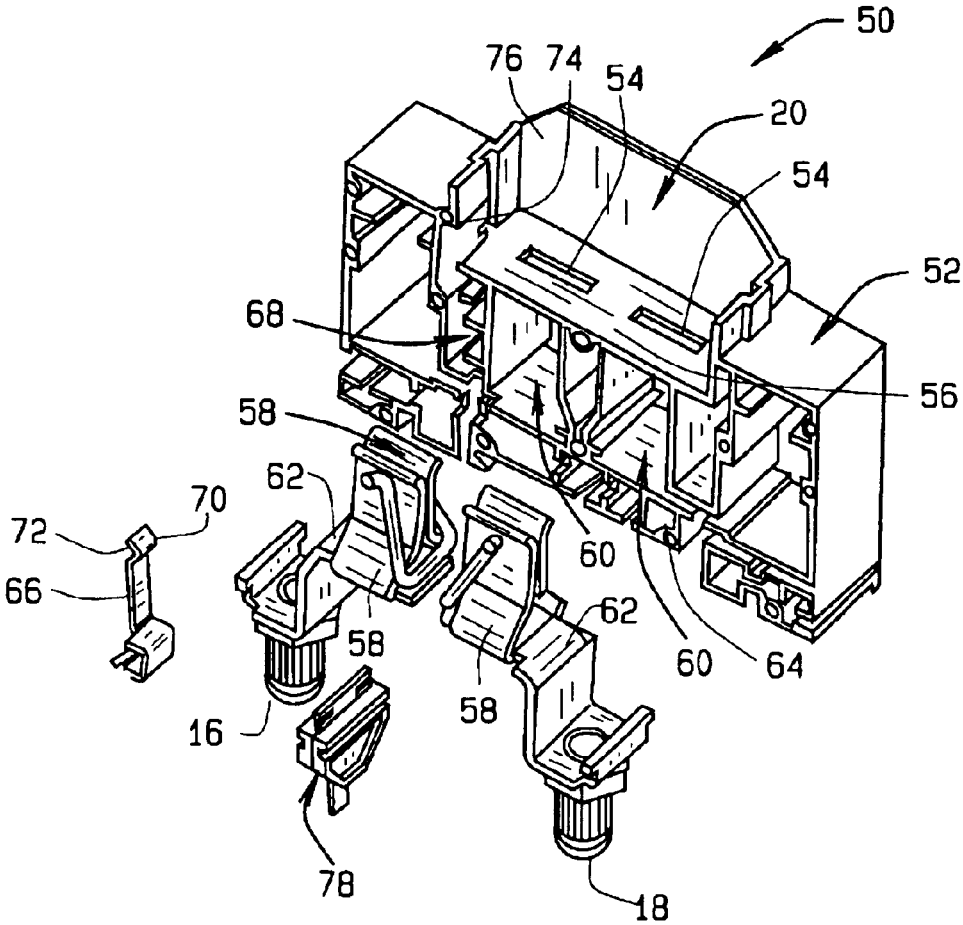
FIG. 3 is a perspective assembly view of the switch housing assembly shown in FIG. 1.
Figure 4:
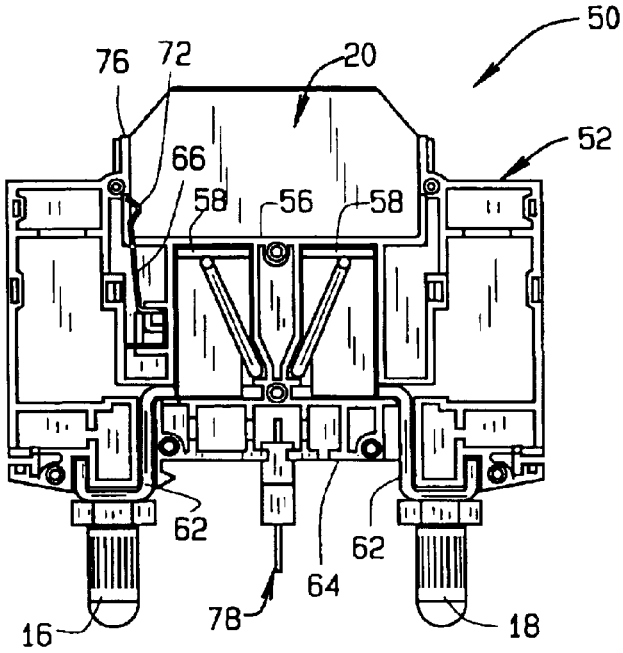
FIG. 4 is a side elevational view with parts removed of the switch housing assembly shown in FIG. 3.

FIGS. 3 and 4 illustrate a first embodiment of switch housing assembly 50 including a housing 52 having fuse terminal openings 54 in a bottom 56 of fuse receptacle 20 for receiving fuse terminal blades 30 (shown in FIG. 2). An electrically conductive resilient clip 58 is located below each fuse terminal opening 54 and located in a cavity 60 below fuse receptacle 20. A bridge portion 62 extends downwardly from each clip 58 and to electrically conductive bullet contact assemblies 16, 18 for connection to either a line input bus (not shown) or a load bus (not shown). When fuse terminals 30 are inserted through fuse terminal openings 54, fuse terminals 30 are received in clips 58 and thus are electrically coupled to bullet contact assemblies 16, 18 protruding through a bottom 64 of housing 52.

A switch housing internal alarm terminal 66 is positioned adjacent one of fuse clips 58 within an adjacent cavity 68, and includes a projecting ridge 70 at a top end 72 that protrudes through an opening 74 in a side wall 76 of fuse receptacle 20. Thus, when fuse 12 is fully inserted into fuse receptacle 20, alarm terminal projecting ridge 70 contacts fuse alarm terminal 42 (shown in FIG. 2) through housing opening 44 (shown in FIG. 2). Internal alarm terminal 66 is further coupled to a remote output alarm terminal 78 that extends though a bottom 64 of switch housing 52, thereby completing an electrical path for an open fuse alarm signal for transmission to end use equipment (not shown) during an open fuse condition.

A fused disconnect switch assembly 10 (shown in FIG. 1) is therefore provided that facilitates installation to existing equipment without auxiliary components or hand wired connections. Switching is achieved by inserting or extracting fuse 12 from switch housing fuse receptacle 20, and local and remote opened fuse indication provides ready indication of opened fuses for replacement. Because a variety of differently rated fuses are accommodated by switch housing receptacle 20, a versatile fused disconnect assembly 10 is provided that is suitable for a wide variety of applications.

Figure 5:
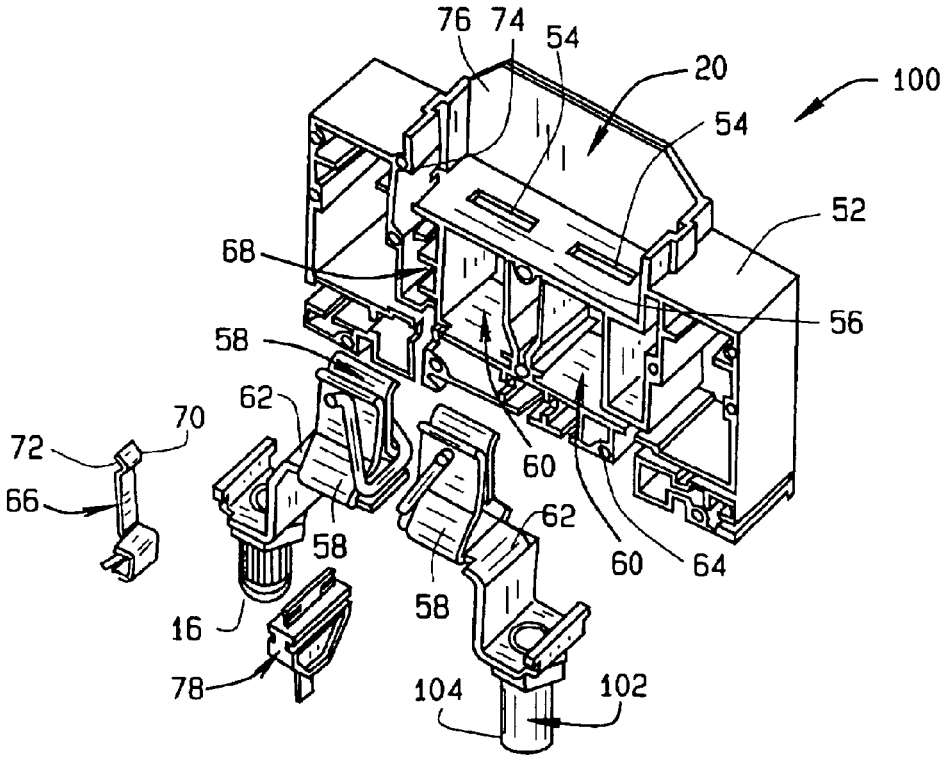
FIG. 5 is a perspective assembly view of a second embodiment of a switch housing assembly.

FIG. 5 illustrates a second embodiment of a switch housing assembly 100 in which common features of switch housing assembly 50 (shown in FIGS. 3 and 4) are referenced with like reference characters. Switch housing assembly 100 is configured for use with a removable fuse, such as fuse 12 (shown in FIGS. 1 and 2). Unlike switch housing assemblies 50, switch housing assembly 100 includes a terminal stud assembly 102 in lieu of bullet contact assembly 18. Terminal stud contact assembly 102 includes a bridge portion 62 extending downwardly from electrically conductive clip 58. Terminal stud contact assembly 102, in one embodiment, is fabricated from steel and attached to bridge portion 62, while in an alternative embodiment terminal stud contact assembly may be integrally formed with bridge portion 62. Terminal stud 102 contact assembly includes threads (not shown) on a lower portion 104 for mounting switch housing assembly 100 within the end use application, such as for example, with a nut or other threaded fastener (not shown). Thus, switch assembly 100 includes one bullet contact assembly 16 and one terminal stud contact assembly 102 for line and load side electrical connections in the end use application.

Therefore, a fused disconnect switch housing 100 is provided that facilitates installation to existing equipment without auxiliary components or hand wired connections with at least two mounting options. Switching is achieved by inserting or extracting a fuse, such as fuse 12, from switch housing receptacle 20, and local and remote opened fuse indication provides ready indication of opened fuses for replacement. Because a variety of differently rated fuses are accommodated by switch housing receptacle 20, a versatile fused disconnect system is provided that is suitable for a wide variety of applications.

Figure 6:
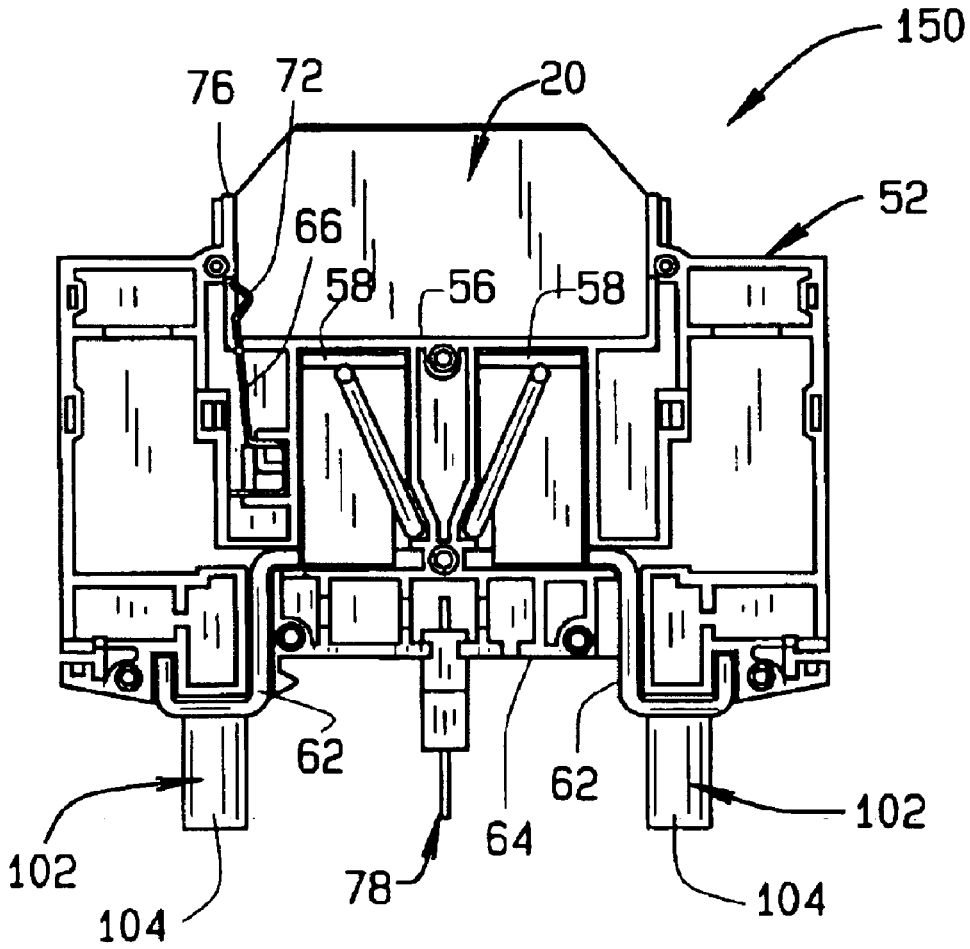
FIG. 6 is a side elevational view of a third embodiment of a switch housing assembly.

FIG. 6 illustrates a third embodiment of a switch housing assembly 150 in which common features of switch housing assembly 50 (shown in FIGS. 3 and 4) and switch housing assembly 100 (shown in FIG. 5) are referenced with like reference characters. Switch housing assembly 150 is configured for use with a removable fuse, such as fuse 12 (shown in FIGS. 1 and 2). Unlike switch housing assembly 50 and 100, switch housing assembly 150 includes first and second terminal stud assemblies 102 in lieu of bullet contact assemblies 16, 18 (shown in FIGS. 1, 3, and 4). Each terminal stud contact assembly 102 includes a bridge portion 62 extending downwardly from electrically conductive clip 58. Terminal stud contact assembles 102, in one embodiment, are fabricated from steel and attached to bridge portions 62. In another embodiment, terminal stud contact assemblies 102 are each integrally formed with bridge portions 62 from an electrically conductive material. Each terminal stud contact assembly 102 includes threads (not shown) on a lower portion 104 for mounting switch housing assembly 150 within the end use application, such as for example, with a nut or other threaded fastener (not shown). Thus, switch assembly 150 includes two terminal stud contact assemblies 102 for line and load side electrical connections in the end use application.

Therefore, a fused disconnect switch housing 150 is provided that facilitates installation to existing equipment without auxiliary components or hand wired connections. Switching is achieved by inserting or extracting a fuse, such as fuse 12, from switch housing receptacle 20, and local and remote opened fuse indication provides ready indication of opened fuses for replacement. Because a variety of differently rated fuses are accommodated by switch housing receptacle 20, a versatile fused disconnect system is provided that is suitable for a wide variety of applications.

Figure 7:
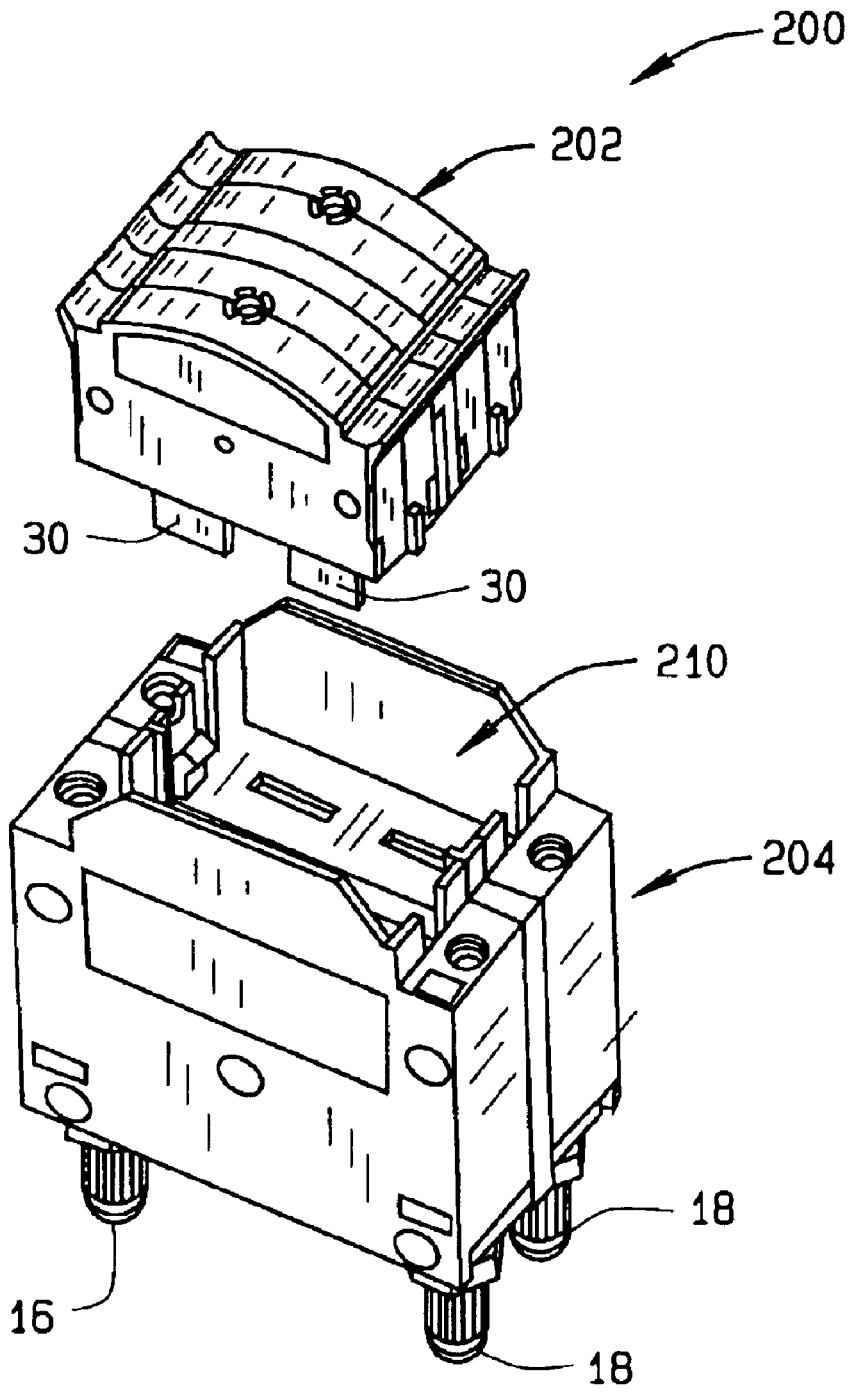
FIG. 7 is a perspective assembly view of a fourth embodiment of a switch housing assembly.

FIG. 7 illustrates a fourth embodiment of a fused disconnect switch assembly 200 configured for higher current applications than the foregoing embodiments, but still maintaining a common footprint. Common features of switch housing assembly 50 (shown in FIGS. 3 and 4), switch housing assembly 100 (shown in FIG. 5), and switch housing assembly 150 (shown in FIG. 6) are referenced with like reference characters.

Assembly 200 is essentially a double-wide version of fused disconnect assembly 10 (shown in FIG. 1) and includes a fuse 202 for removable engagement with a switch housing 204. In other words, the construction and operation of fuse 202 and switch housing assembly 204 is substantially similar to that described above in relation to FIGS. 1–3 with the exception that assembly 200 includes two line-side bullet contact assemblies (only one of which is shown in FIG. 7) and two load-side bullet contact assemblies 18 for plug in connection to, for example, a line input bus (not shown) and load-side equipment (not shown), respectively. Likewise, fuse 202 includes four male terminal contacts 30 (only two of which are visible in FIG. 7) received in fuse terminal openings (not shown in FIG. 7) in a bottom of a fuse receptacle 210.

When fuse 202 is inserted into fuse receptacle 210, and further when bullet contact assemblies 16, 18 are coupled to line side and load equipment, first and second fused circuits are established in parallel through fuse 202 between each pair of bullet contact assemblies 16 and 18. The load may be disconnected by extraction of fuse 202 from switch housing assembly 204.

In one embodiment, and as explained further below, fuse 202 includes a first fuse link (not shown in FIG. 7) and a secondary fuse link (not shown in FIG. 7) extending between each pair of fuse terminal contacts 30 such that the fuse links extend electrically in parallel to one another. Local fuse state indication via LED 38 (shown in FIG. 2) and remote opened fuse state indication via fuse alarm terminal 42 (shown in FIG. 2) are employed with the parallel fuse links for local and remote fuse state indication, respectively. The primary fuse links are fabricated so that fuse 202 has a combined rating of 130 to 250 amps and a safety interrupt of 100 kA at 80 Vdc.

It is recognized that system 200 could be further extended to obtain even greater amperage ratings, e.g., a triple-wide fuse and switch housing assembly could be employed.

Figure 8:
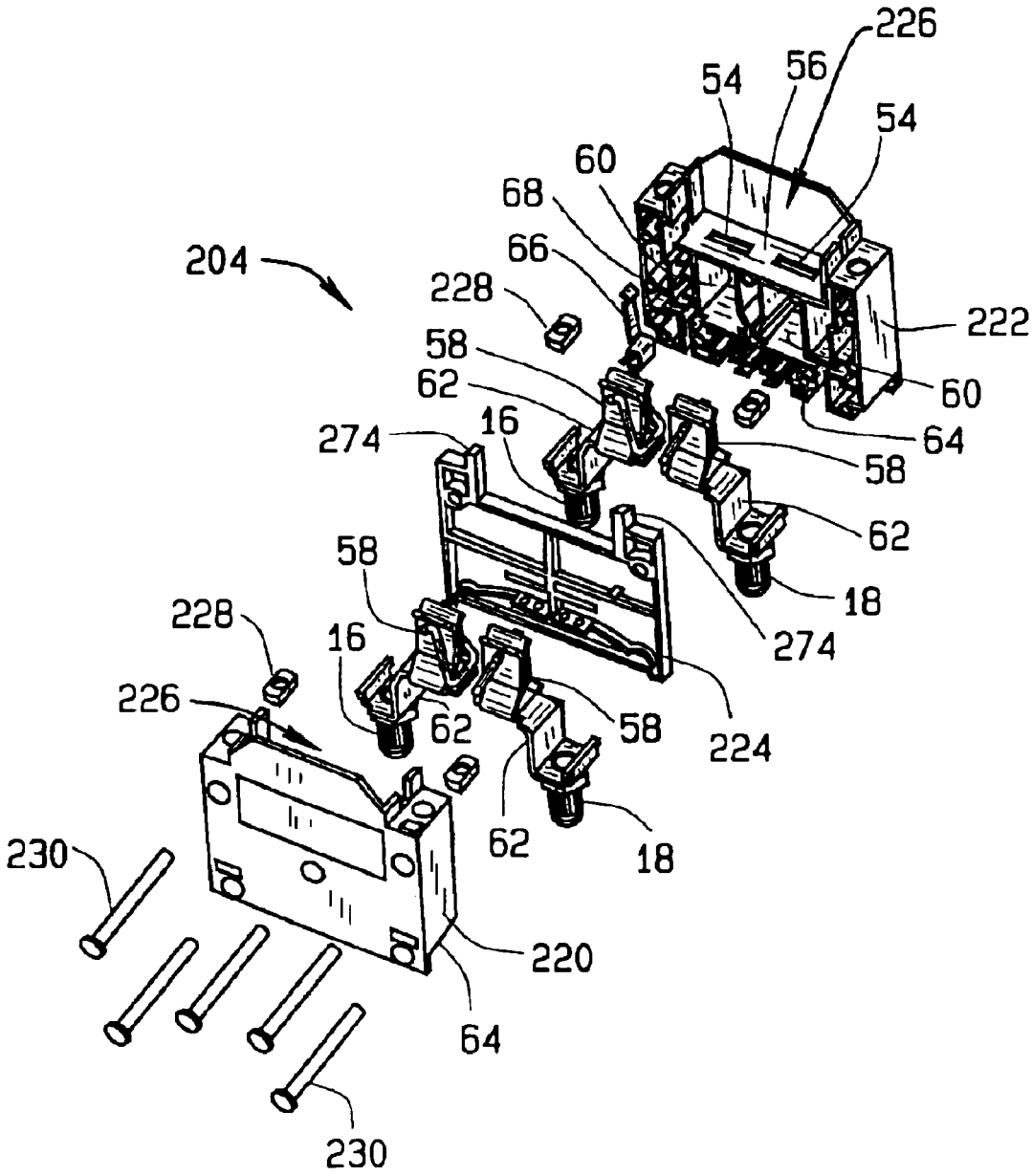
FIG. 8 is an exploded view of the switch housing assembly shown in FIG. 7.

FIG. 8 is an exploded view of a switch housing assembly 204 including substantially identical front and rear housings 220, 222 and a spacer element 224 located therebetween. Each housing 220, 222 includes fuse terminal openings 54 in a bottom 56 of a fuse receptacle 226 that forms approximately one half of fuse receptacle 210 (shown in FIG. 7) for receiving fuse terminal blades 30 (shown in FIG. 7). Electrically conductive resilient clips 58 are located below each fuse terminal opening 54 and located in cavities 60 below fuse receptacle 226. Bridge portions 62 extend downwardly from each clip 58 and to electrically conductive bullet contact assemblies 16, 18 for connection to either a line input bus (not shown) or a load bus (not shown). When fuse terminals 30 (shown in FIG. 1) are inserted through fuse terminal openings 54, fuse terminals 30 are received in clips 58 and thus are electrically coupled to bullet contact assemblies 16, 18 protruding through a bottom 64 of housings 220 and 222.

Switch housing internal alarm terminal 66 is positioned adjacent one of fuse clips 58 within an adjacent cavity 68 in housing 222, and includes a projecting ridge 70 (shown in FIG. 3) at a top end 72 (also shown in FIG. 3) that protrudes through an opening 74 (as shown in FIG. 3) in a side wall 76 (see FIG. 3) of fuse receptacle 226. Thus, when fuse 202 (shown in FIG. 7) is fully inserted into fuse receptacle 210 (shown in FIG. 7), jointly formed by receptacles 226 of each housing 220, 222, alarm terminal projecting ridge 70 contacts fuse alarm terminal 42 (shown in FIG. 2) through housing opening 44 (shown in FIG. 2). Internal alarm terminal 66 is further coupled to a remote output alarm terminal (not shown in FIG. 8 but similar to terminal 78 shown in FIG. 3) that extends though a bottom 64 of switch housing 220 and 222, thereby completing an electrical path for an open fuse alarm signal for transmission to end use equipment (not shown) during an open fuse condition.

Mounting footings 228 are provided in each housing 220, 222 adjacent fuse receptacles 226, and known fasteners 230 are extended through openings in housings 220, 222 and spacer element 224 to secure assembly 204 in an assembled condition as shown in FIG. 7.

Figure 9:
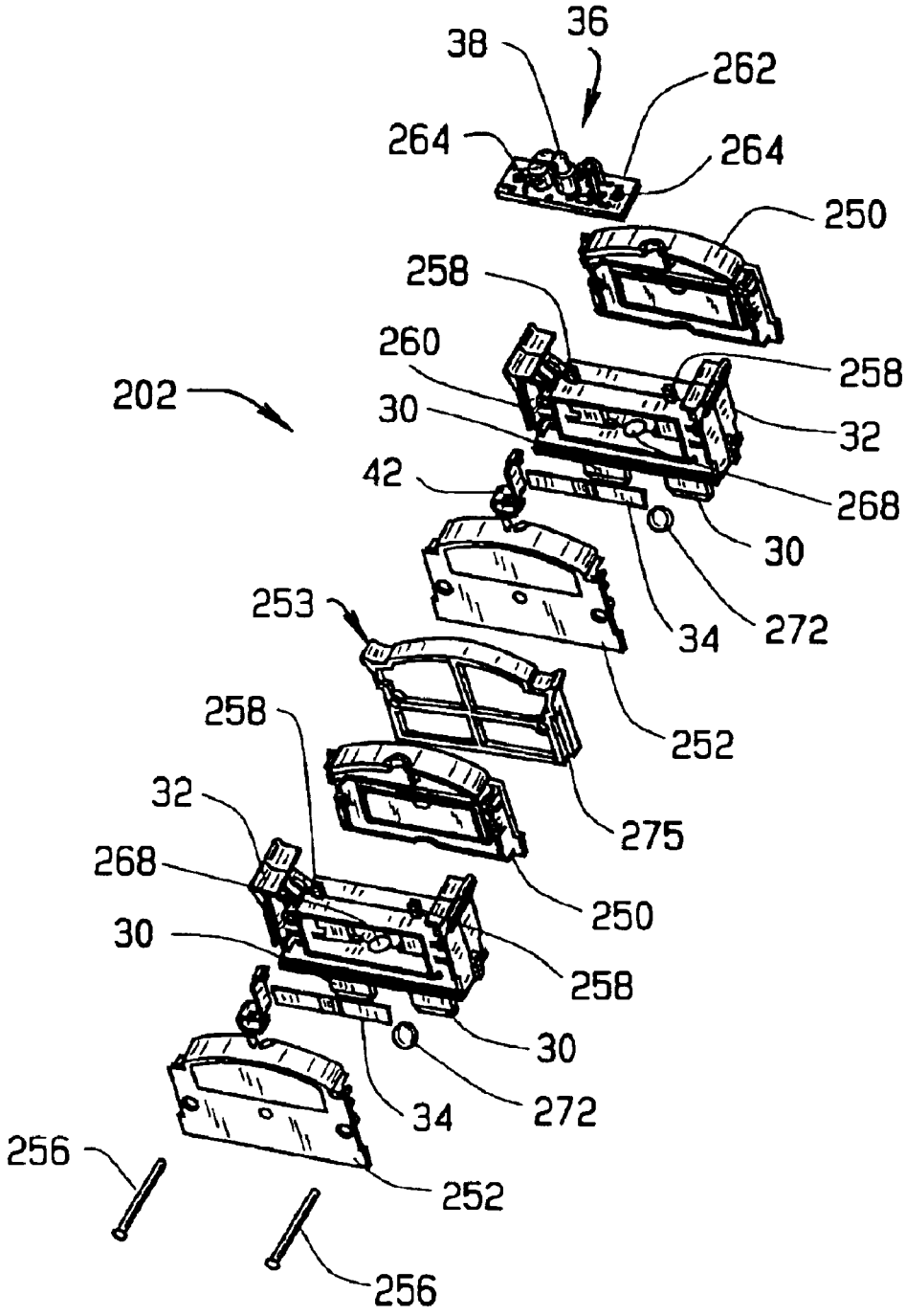
FIG. 9 is an exploded view of the fuse shown in FIG. 7.

FIG. 9 is an exploded view of fuse 202 wherein like features of fuse 12 (shown in FIGS. 1 and 2) are designated with like reference characters.

Fuse 202 includes two pairs of opposite front and back covers 250, 252, separated by a spacer element 253 and attached to one another according to known methods and techniques, including but not limited to rivets 256 and screws (not shown), adhesive processes and ultrasonic welding processes. Disposed between each pair of front and back covers 250, 252 is a fuse housing 32. A pair of fuse terminals 30 extend from each of two fuse housings 32, and a primary fuse link 34 is electrically coupled to each pair of fuse terminals 30. Fuse links 34 extend in parallel with one another across respective pairs of fuse terminals 30, one terminal forming a line-side electrical connection and the other terminal forming a load-side electrical connection.

As illustrated in FIG. 9, each fuse link 34 is a substantially flat and generally linear conductive strip including an area of reduced cross section, or a weak spot therein. Upon an occurrence of a predetermined current fault condition, dependent upon dimensions and characteristics of fuse link 34, the weak spot reaches an operating temperature sufficient to melt, disintegrate, vaporize, decompose, or otherwise open fuse links 34 at or near the weak spot to break an electrical connection through fuse links 34. It is contemplated, however, that a variety of fuse elements may be employed in alternative embodiments in lieu of the illustrative fuse links 34 without departing from the scope of the present invention. For instance, non-linear (e.g., bent or curved) fuse elements, fuse elements including a plurality of weak spots, and wire fuse elements without weak spots, in addition to other fuse elements familiar to those in the art, may be likewise employed in the present invention. Additionally, in one embodiment, primary fuse links 34 are fabricated so that when connected in parallel fuse 202 has a combined rating of 130 to 250 amps and a safety interrupt of 100 kA at 80 Vdc. It is appreciated, however, that in alternative embodiments, fuse links 34 may be constructed to meet other performance objectives.

In an alternative embodiment, common line-side terminals 30 and common load-side terminals 30 are employed by electrically coupling respective terminals 30 of each housing 32. Thus, for example, a U-shaped line contact terminal may be employed with the legs of the U extending through a bottom of fuse housings 32 and a U-shaped load contact terminal may be employed with the legs of the U extending through a bottom of fuse housings 32. Primary fuse links 34 may then be extended between a leg of the line terminal and a leg of the load terminal within each of fuse housings 32.

Terminal posts 258 extend through a top surface of fuse housings 32 for establishing an electrical connection to open circuit indication device 36. Alarm terminal 42 is fitted within a compartment 260 of one of housings 258 and also is established in electrical communication with open circuit indication device 36.

Open fuse indication device 36 includes a printed circuit board 262 including apertures 264 for electrical connection to terminal posts 258 that are in turn, coupled to fuse terminals 30 for establishing line and load electrical connections to external circuitry (not shown). Printed circuit board 262 includes high resistance electronic circuitry, explained below, that operates LED 38 in response to a voltage drop across terminal posts 258 when primary fuse links 34 melt, disintegrates, vaporizes or otherwise opens and breaks an electrical connection between fuse terminals 30 via fuse links 34. As such, LED 38 is illuminated when fuse links 34 operate, thereby providing local fuse state indication. Circuitry on printed circuit board 264 also signals external equipment, such as a relay in a telecommunications system, through alarm terminal 42 and associated alarm terminals of a switch housing assembly such as assembly 204 (shown in FIG. 8).

LED 38 protrudes through an opening in one of fuse housings 32 so that fuse state indication is readily ascertainable from visual inspection of LED 38. If LED 38 is not illuminated, fuse 202 is functional, i.e., fuse links 34 have not opened due to fault current conditions. On the other hand, if LED 38 is illuminated, fuse 202 has operated and should be replaced with a functional fuse.

Fuse housings 32 each further include an opening 268 extending through bottom of fuse housing 32 to facilitate introduction of an arc quenching media, such as silica sand, to surround terminals 30 and fuse link 34 within each housing 32. The arc quenching media prevents and/or suppresses arcing between fuse terminals 30 when fuse links 34 open. A plug 272 is inserted into each opening 268 after fuse housings 32 are filled with the arc quenching media to seal fuse 202. In an exemplary embodiment, plug 272 is a ball fabricated from nylon or other suitable materials and applied to opening 268 according to known techniques.

Additionally, a polarization projection 274 extends from each side of spacer element 224 (shown in FIG. 8) and projection 274 is received in complementary grooves 275 formed into each lateral side of fuse spacer element 253. Projection 274 prevents insertion of fuse 202 into fuse receptacle 210 except in a designated orientation when projections 274 are inserted into groove 275. Thus, correct polarization of the fuse terminals is ensured with respect to associated line and load connections with the applicable switch housing assembly.

Fuse 202 in combination with switch housing assembly 204 (shown in FIG. 8) provides a fused disconnect assembly 200 (shown in FIG. 7) that facilitates installation to existing equipment without auxiliary components or hand wired connections and is capable of higher current protection than assembly 10 (shown in FIG. 1). Switching is achieved by inserting or extracting fuse 202 from switch housing fuse receptacle 210 (shown in FIG. 7), and local and remote opened fuse indication provides ready indication of opened fuses for replacement. Because a variety of differently rated fuses are accommodated by switch housing receptacle 210, a versatile fused disconnect system is provided that is suitable for a wide variety of applications.

Figure 10:
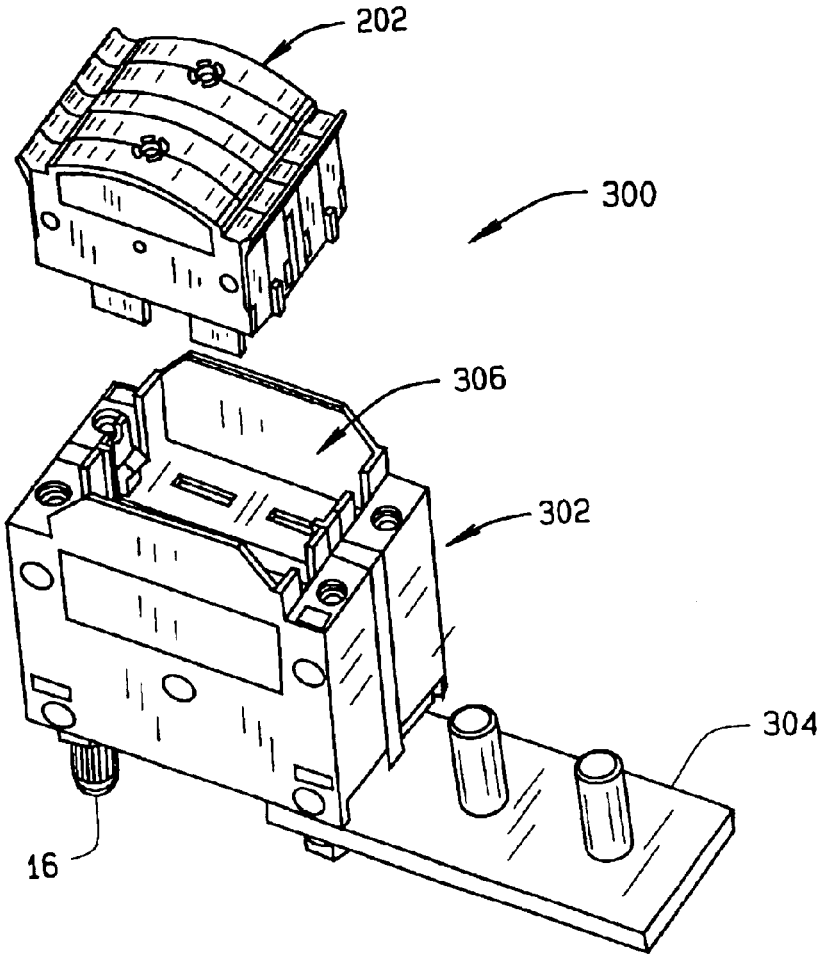
FIG. 10 is perspective view of a fifth embodiment of a switch housing assembly.

FIG. 10 is perspective view of another embodiment of a fused disconnect assembly 300 including fuse 202 and a switch housing assembly 302 coupled to a common output bus 304.

It may be recognized that switch housing assembly 302 is essentially a double-wide version of switch housing assembly 100 (shown in FIG. 5) to facilitate enhanced overcurrent protection in conjunction with fuse 202. Accordingly, switch housing assembly 302 includes a fuse receptacle 306, a pair of bullet contact assemblies 16 for line-side connection to external circuitry, and a pair of load-side terminal contact assemblies 102 (not shown in FIG. 10) that are connected to output bus 304. When fuse 202 is inserted into fuse receptacle 306, and further when bullet contact assemblies 16 are coupled to line-side connections, an electrical circuit is established through fuse 202 between each respective pair of bullet contact assemblies 16 and the terminal contact assemblies 102. The load may be disconnected by extraction of fuse 202 from switch housing assembly 306.

Figure 11:
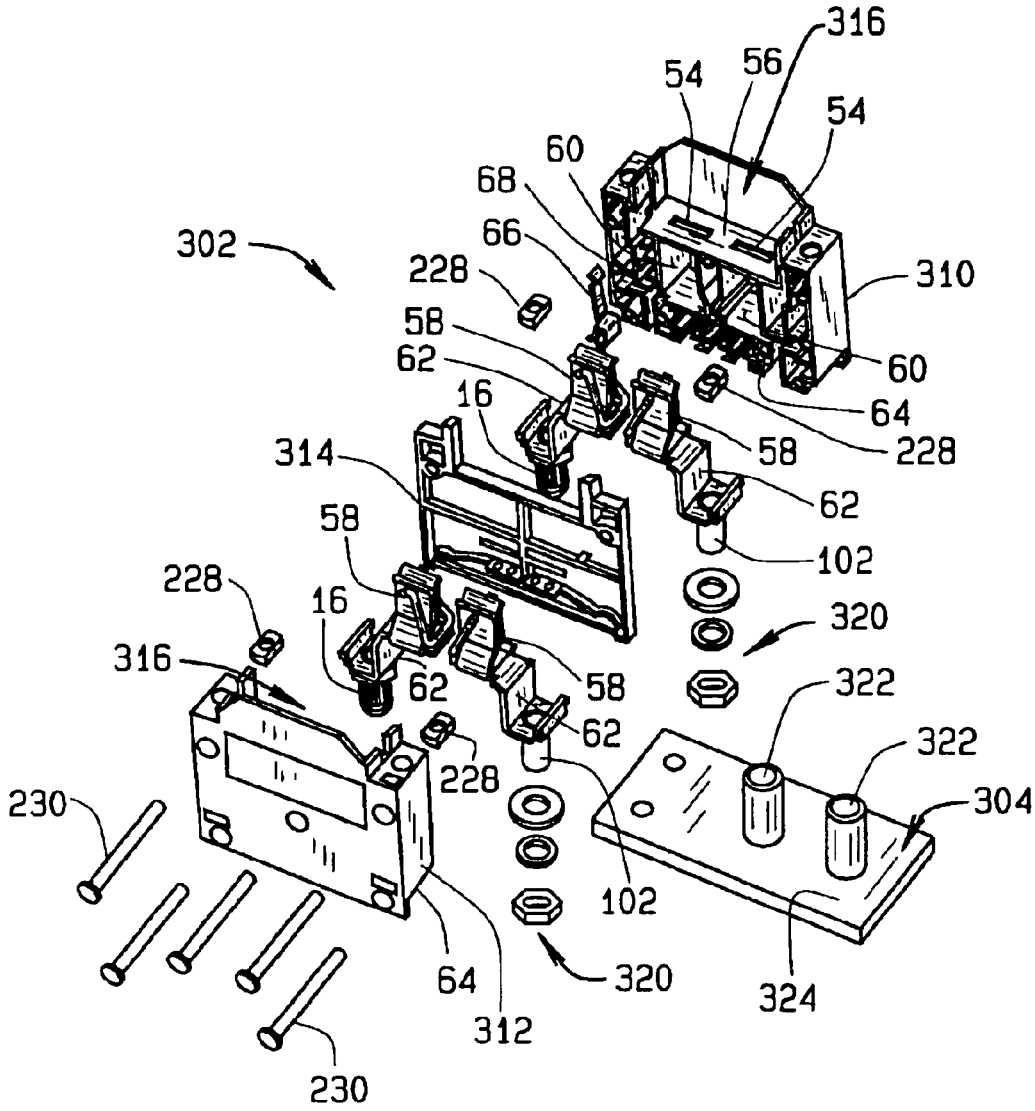
FIG. 11 is an exploded view of the switch housing assembly shown in FIG. 10.

FIG. 11 is an exploded view of a switch housing assembly 302 including substantially identical front and rear housings 310, 312 and a spacer element 314 located therebetween. Each housing 310, 312 includes fuse terminal openings 54 in a bottom 56 of a fuse receptacle 316 that forms approximately one half of fuse receptacle 306 (shown in FIG. 10) for receiving fuse terminal blades 30 (shown in FIG. 9). Electrically conductive resilient clips 58 are located below each fuse terminal opening 54 and located in cavities 60 below fuse receptacle 316. Bridge portions 62 extend downwardly from each clip 58 and to electrically conductive bullet contact assemblies 16 for line-side electrical connection, and also to electrically conductive terminal stud contact assemblies 102 for load-side electrical connections. When fuse terminals 30 (shown in FIG. 9) are inserted through fuse terminal openings 54, fuse terminals 30 are received in clips 58 and thus are electrically coupled to bullet contact assemblies 16 and to terminal stud contact assemblies 102 protruding through a bottom 64 of housings 310 and 312.

Switch housing internal alarm terminal 66 is positioned adjacent one of fuse clips 58 within an adjacent cavity 68 in housing 310, and includes a projecting ridge 70 (shown in FIG. 3) at a top end 72 (also shown in FIG. 3) that protrudes through an opening 74 (as shown in FIG. 3) in a side wall 76 (see FIG. 3) of fuse receptacle 310. Thus, when fuse 202 (shown in FIG. 10) is fully inserted into fuse receptacle 306 (shown in FIG. 10) that is jointly formed by receptacles 316 of each housing 310, 312, alarm terminal projecting ridge 70 contacts fuse alarm terminal 42 (shown in FIG. 9) through an opening in fuse housing 32 (similar to opening 44 shown in FIG. 2). Internal alarm terminal 66 is further coupled to a remote output alarm terminal (not shown in FIG. 11 but similar to terminal 78 shown in FIG. 5) that extends though a bottom 64 of switch housings 310 and 312, thereby completing an electrical path for an open fuse alarm signal for transmission to end use equipment (not shown) during an open fuse condition.

Mounting footings 228 are provided in each housing 310, 312 adjacent fuse receptacles 316, and known fasteners 230 are extended through openings in housings 310, 312 and spacer element 314 to secure assembly 302 in an assembled condition as shown in FIG. 10.

Output bus 304 is coupled to terminal stud contact assemblies 102 with known fasteners 320 and includes terminal stud connectors 322 extending from a top surface 324 of bus element 304.

Fuse 202 in combination with switch housing assembly 302 provides a fused disconnect switch assembly 300 (shown in FIG. 10) that facilitates installation to existing equipment without auxiliary components or hand wired connections and is capable of higher current protection than a system utilizing switch housing assembly 100 (shown in FIG. 5). Switching is achieved by inserting or extracting fuse 202 from switch housing fuse receptacle 306 (shown in FIG. 10), and local and remote opened fuse indication provides ready indication of opened fuses for replacement. Because a variety of differently rated fuses are accommodated by switch housing receptacle 306, a versatile fused disconnect system 300 is provided that is suitable for a wide variety of applications.

It is recognized that system 300 could be further extended to obtain even greater amperage ratings, e.g., a triple-wide fuse and switch housing assembly could be employed.

Figure 12:
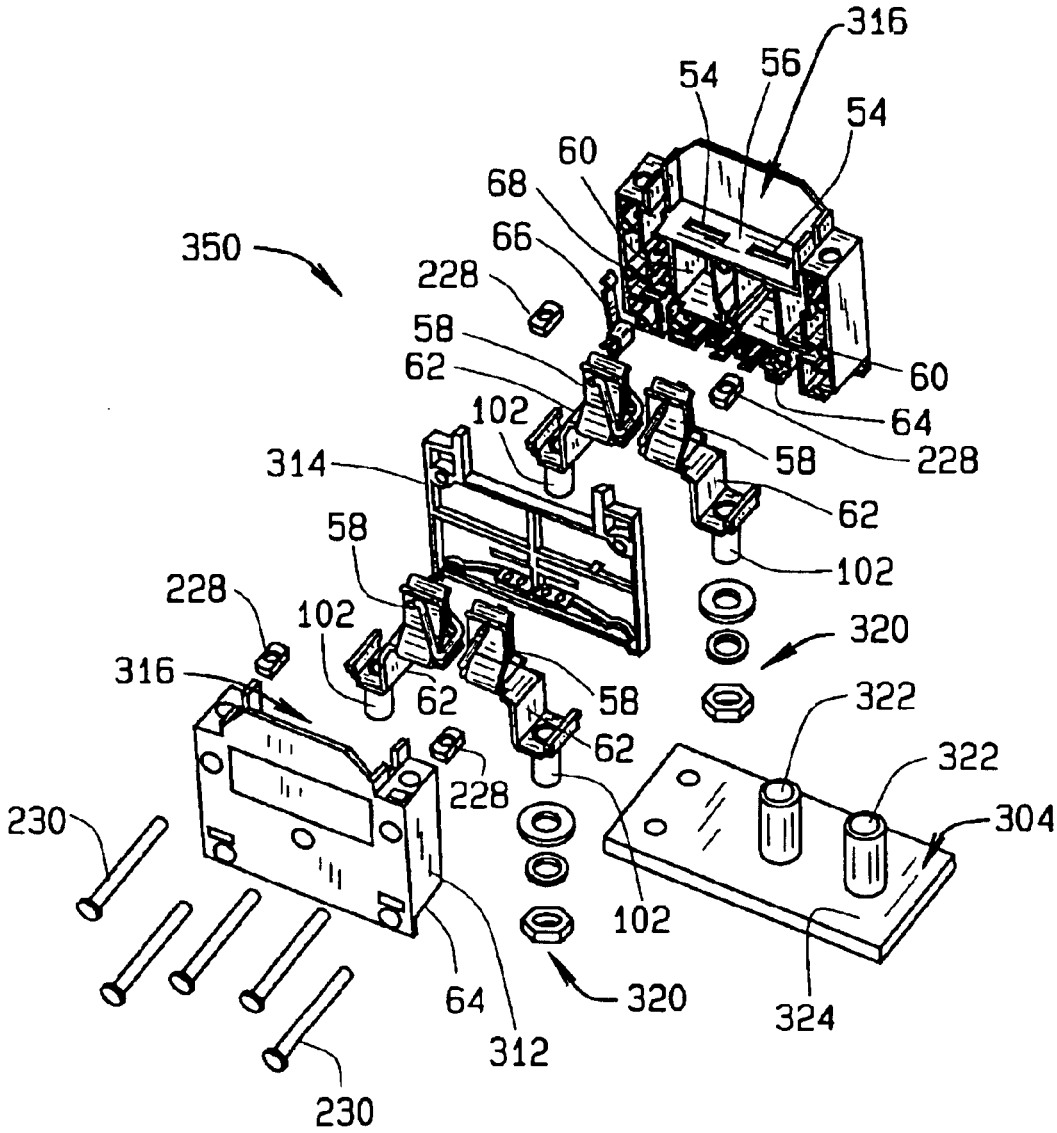
FIG. 12 is an exploded view of a sixth embodiment of a switch housing assembly.

FIG. 12 is an exploded view of a yet another embodiment of a switch housing assembly 350 similar to switch housing assembly 302 (shown in FIG. 11). Switch housing assembly 350 is substantially similar to switch housing assembly 302 with the exception of terminal stud contact assemblies 102 are employed to form both line-side and load-side electrical connectors. In other words, bullet contact assemblies 16 (shown in FIG. 11) are replaced with terminal stud contact assemblies 102. For ease of reference, common features of assembly 350 and assembly 302 are indicated with like reference characters.

Figure 13:
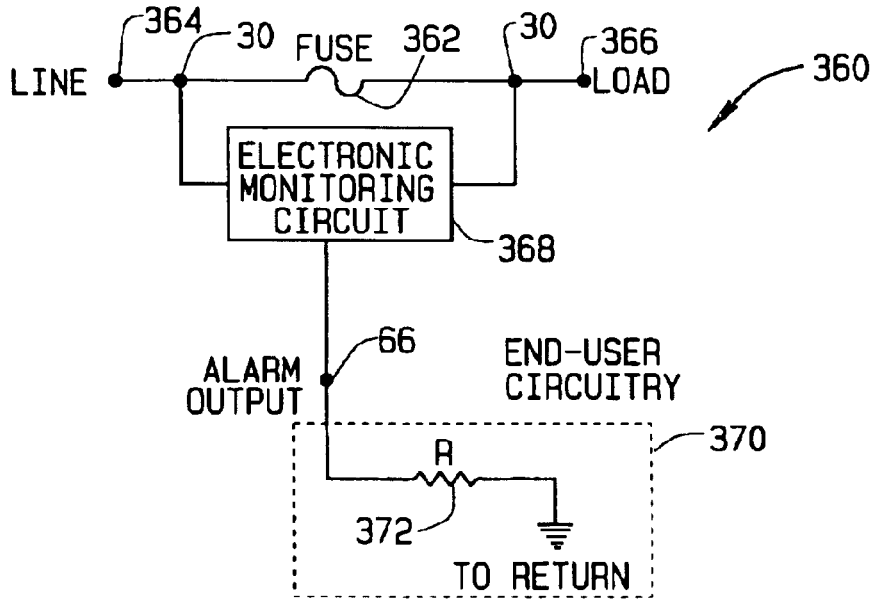
FIG. 13 is an alarm circuit schematic for the fuses shown in FIGS. 1, 2, 7 and 9.

FIG. 13 schematically illustrates an alarm circuit 360 for a fuse 362, such as fuse 12 (shown in FIGS. 1 and 2) or fuse 202 (shown in FIGS. 7, 9 and 10). Fuse terminals 30 (shown in FIGS. 1, 2, 7 and 10) are connected to line and load circuitry of the end use application at points 364 and 366 through applicable terminal contact portions of a switch housing assembly, such as those described above. An electrical circuit is therefore established through fuse link(s) 34 (shown in FIGS. 2 and 9) and through an electronic monitoring circuit 368 formed on printed circuit board 262 (shown in FIG. 9) of open fuse indication device 36 (also shown in FIG. 9). Electronic monitoring circuit 368 has a sufficiently high resistance so that in normal operation of fuse 362 substantially all of the current flowing through the fuse passes through fuse link 34.

When fuse link 34 opens in a current overload or short circuit condition, electronic monitoring circuit 368 detects a voltage drop across terminals 30 and illuminates LED 38, as well as outputs an alarm signal through alarm terminal 42 (both shown in FIGS. 2 and 9) to a remote output alarm terminal 66 of a switch housing assembly, such as those described above. Alarm terminal output 66 is coupled to end-user circuitry 370 that in an illustrative embodiment, includes a relay 372 that may be used to identify a location of an operated or opened fuse 362 in a system employing a large number of fuses in various locations. In one embodiment, a load side of LED 38 is connected to output alarm terminal 66, thereby supplying 20 mA current to relay 372 for remote fuse state indication. Thus, as LED 38 is energized, a remote alarm signal is also sent through output alarm terminal 66.

Figure 14:
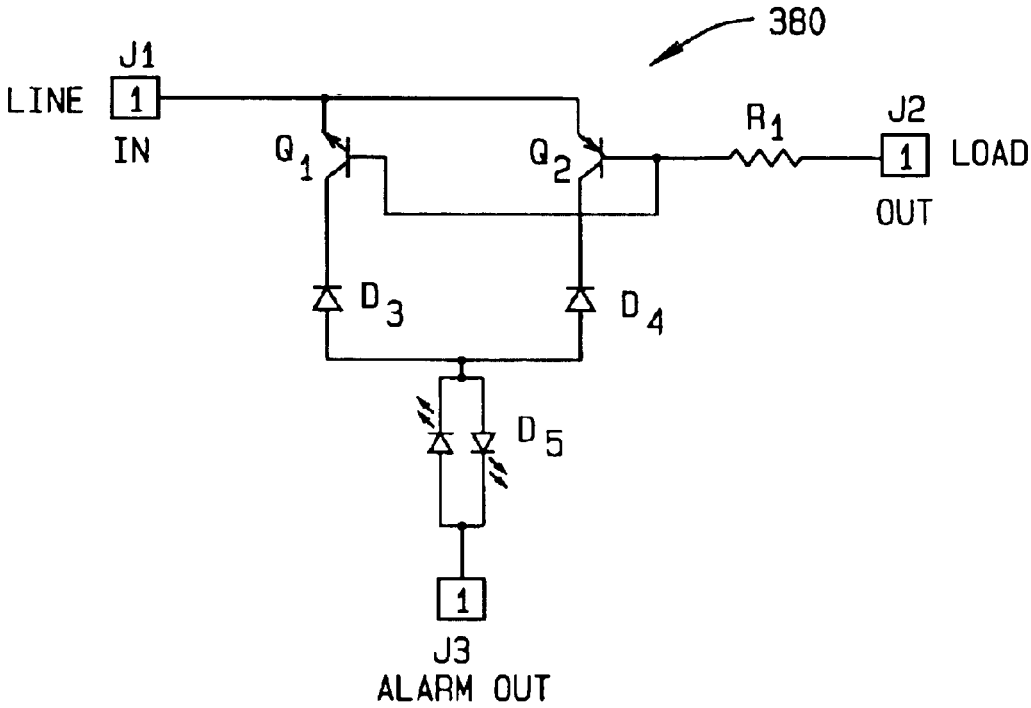
FIG. 14 is one embodiment of an alarm circuit for the schematic shown in FIG. 13.

FIG. 14 illustrates an exemplary electronic monitoring circuit 380 for alarm circuit 368 (shown in FIG. 13). Terminal J1 is coupled to the line or input side of the fuse, and more specifically, to fuse terminal posts 258 (shown in FIG. 9) that is associated with-line side circuitry of the fuse application. Terminal J2 is coupled to the load or output side of the fuse, and more specifically, to fuse terminal post 258 (shown in FIG. 9) that is associated with load side circuitry of the fuse application. Terminal J3 is electrically connected through an appropriate impedance to the return or common electrical ground of the fused circuit. A pair of matched transistors, namely an NPN transistor Q1 and a PNP transistor Q2 are employed with diodes D3, D4 to prevent current leakage (about 1.2. mA in one embodiment) through respective transistors Q1, Q2, Therefore, diodes D3, D4 prevent false fuse state indication resulting from low base emitter voltage of transistors Q1 and Q2, and further provide transient immunity for electronic monitoring circuit 368 arc-voltage during operation of the fuse. A bipolar LED 38 (indicated by D5 in FIG. 14 and also shown in FIG. 9) is coupled to transistors Q1, Q2 and terminal J3.

In normal operation, electronic monitoring circuit 368 is a passive component, i.e., active components of electronic monitoring circuit are non-conducting and voltage drop across terminals J1 and J2 is negligible. Consequently, LED 38 is not illuminated and stress on the circuit components is primarily thermal. However, after an overload or short-circuit condition in the fused circuit causes fuse 202, or more specifically fuse links 34 to operate, the resultant voltage drop across terminals J1 and J2 causes either transistor Q1 or Q2, depending upon system voltage polarity, to saturate and actively conduct to energize LED 38.

More specifically, in case of positive system voltage, full system voltage is impressed across terminals J1 and J2 when fuse links 34 have opened, thereby forward biasing a base-emitter junction of PNP transistor Q2 through resistor R1. In this condition, as the base-emitter junction voltage is greater than an associated minimum forward bias voltage, a transistor collector-emitter junction of PNP transistor Q2 saturates and the system voltage is applied across LED 38, thereby illuminating the LED.

In case of a negative system voltage, full system voltage is impressed across terminals J1 and J2 when fuse links 34 have opened, thereby forward biasing a base-emitter junction of NPN transistor Q1 through resistor R1. In this condition, as the base-emitter junction voltage is greater than an associated minimum forward bias voltage, a transistor collector-emitter junction of NPN transistor Q1 saturates and the system voltage is applied across LED 38, thereby illuminating the LED.

Appropriate selection of resistor R1 ensures saturation of transistors Q1, Q2 under positive and negative voltage conditions. Saturation of transistors Q1, Q2 electronically switches the line or input side of the fuse at terminal J1 in series with the alarm output terminal J3, thereby illuminating the bipolar LED 38 to locally indicate the presence of an open-fuse condition. For remote open-fuse alarm indication, terminal J3 is connected to the return or common electrical ground of the fused circuit through a device such as a relay as illustrated in FIG. 13. When an open-fuse condition exists, the electronic monitoring circuit 368 will cause the relay to change state and provide the ability to remotely identify the presence of the open-fuse condition.

In a particular embodiment, transistors Q1 and Q2 have a voltage rating of at least 200 VDC to ensure proper operation of electronic monitoring circuit at system voltages of 80 VDC. In addition, a base current of at least about 100 $\mu$A is required in one embodiment for transistors Q1, Q2 to function properly. Still further, in one embodiment, utilizing a minimum turn on voltage of 18 VDC, resistor R1 has a value of about 59 Kohms, thereby resulting in a base current of about 300 $\mu$A.

While the invention has been described in terms of various specific embodiments, those skilled in the art will recognize that the invention can be practiced with modification within the spirit and scope of the claims.

What is claimed is:

1. A fused disconnect switch comprising:

at least one switch housing assembly configured to receive a retractable fuse;

said switch housing assembly comprising a receptacle for insertion of said retractable fuse and first and second terminal contact assemblies extending from said receptacle, wherein at least one of said first and second terminal contact assemblies-comprises a bullet contact assembly; and a retractable fuse comprising a fuse housing and a primary fuse link contained within said fuse housing, and first and second fuse terminals extending from said housing, said primary fuse link extending interior to said fuse housing between said first and second fuse terminals, and an open circuit indication device within said fuse housing and coupled to said first and second fuse terminals;

wherein at least a portion of said retractable fuse housing is exposed when said retractable fuse is inserted into said receptacle and said first and second fuse terminals are respectively coupled electrically to said first and second terminal contact assemblies, said retractable fuse being removably engageable with said switch housing assembly via said exposed portion.

2. A fused disconnect switch in accordance with claim 1 wherein both of said first and second terminal contact assemblies comprise a bullet contact assembly.

3. A fused disconnect switch in accordance with claim 1, at least one of said first and second terminal contact assemblies comprising a terminal stud contact assembly.

4. A fused disconnect switch in accordance with claim 1 wherein said primary fuse link is rated at about 130 amps to 250 amps.

5. A fused disconnect switch in accordance with claim 1, said open circuit indication device comprising a high resistance electronic circuit.

6. A fused disconnect switch in accordance with claim 1 further comprising a second primary fuse link extending interior to said fuse housing, said first and second fuse links connected in parallel.

7. A fused disconnect switch comprising:

at least one switch housing assembly comprising a switch housing defining a receptacle for receiving a retractable fuse, and first and second terminal contact assemblies extending from said receptacle, wherein at least one of said first and second contact assemblies comprises a terminal stud contact assembly; and a retractable fuse comprising a fuse housing containing a first primary fuse link and a second primary fuse link-extending interior to said fuse housing, said first and second fuse links connected in parallel, and first and second fuse terminals extending from said fuse housing, said primary fuse link mechanically and electrically connected to said first and second fuse terminals, and an open circuit indication device within said fuse housing and mechanically and electrically connected to said first and second fuse terminals;

wherein at least a portion of said retractable fuse housing is exposed from an exterior of said switch housing assembly when said retractable fuse is electrically coupled to said switch housing assembly, said retractable fuse being removably engageable with said switch housing assembly via said exposed portion.

8. A fused disconnect switch in accordance with claim 7, said first and second terminal contact assemblies comprising a terminal stud contact assembly.

9. A fused disconnect switch in accordance with claim 7, the other of said first and second contact assemblies comprising a bullet contact assembly.

10. A fused disconnect switch in accordance with claim 7 wherein said primary fuse link is rated at about 130 amps to 250 amps.

11. A fused disconnect switch in accordance with claim 10, said fuse comprising an alarm terminal, said switch housing assembly comprising an alarm terminal, said fuse alarm terminal in communication with said switch housing alarm terminal when said fuse is received in said receptacle.

12. A fused disconnect switch comprising:

at least one switch housing assembly comprising a housing defining a receptacle for receiving a retractable fuse, and first and second terminal contact assemblies extending from said receptacle, wherein one of said first and second contact assemblies comprises a bullet contact assembly and one of said first and second contact assemblies comprises a terminal stud contact assembly; and a retractable fuse removably engagable to said fuse receptacle, said retractable fuse comprising a fuse housing, first and second fuse terminals extending from said fuse housing, and a primary fuse link and an open fuse indication device each extending interior to said fuse housing and coupled to said first and second terminals;

wherein at least a portion of said fuse housing is exposed to an exterior of said fuse receptacle when said retractable fuse is connected to said switch housing assembly.

13. A fused disconnect switch in accordance with claim 12 wherein said primary fuse link is rated at about 130 amps to 250 amps.

14. A fused disconnect switch in accordance with claim 13, said fuse comprising an alarm terminal, said switch housing assembly comprising an alarm terminal, said fuse alarm terminal in communication with said switch housing alarm terminal when said fuse is received in said fuse receptacle.

15. A fused disconnect switch in accordance with claim 12 further comprising a second primary fuse link received in said fuse receptacle, said first and second fuses connected in parallel in said fuse housing.

16. A fused disconnect switch in accordance with claim 12 wherein said open circuit indication device comprises an electronic circuit.

17. A fused disconnect switch comprising a switch housing comprising a receptacle for removable engagement with a fuse, first and second line-side contact assemblies extending from said fuse receptacle, and first and second load-side contact assemblies extending from said fuse receptacle;

wherein said fuse comprises a fuse housing, a first primary fuse link extending interior to and enclosed by said fuse housing between said first line-side contact assembly and said first load-side contact assembly and a second primary fuse link extending interior to and enclosed by said fuse housing between said second line-side contact assembly and said second load-side contact assembly, said first and second line side contact assembly comprising a bullet contact assembly.

18. A fused disconnect switch in accordance with claim 17, said first and second load-side contact assembly comprising a bullet contact assembly.

19. A fused disconnect switch in accordance with claim 18 further comprising a common bus coupled to first and second load-side contact assembly.

20. A fused disconnect switch comprising a switch housing comprising a receptacle for removable engagement with a fuse, first and second line-side contact assemblies extending from said fuse receptacle, and first and second load-side contact assemblies extending from said fuse receptacle;

wherein said fuse comprises a fuse housing, a first primary fuse link extending interior to and enclosed by said fuse housing between said first line-side contact assembly and said first load-side contact assembly and a second primary fuse link extending interior to and enclosed by said fuse housing between said second line-side contact assembly and said second load-side contact assembly, said first and second load-side contact assembly comprising a terminal stud contact assembly.

* * * * *